US008844232B1

(12) United States Patent
Jung et al.

(10) Patent No.: US 8,844,232 B1
(45) Date of Patent: Sep. 30, 2014

(54) CEILING MOUNT SYSTEM

(71) Applicant: Soon Kie Jung, Saddle River, NJ (US)

(72) Inventors: Hoe Y. Jung, Saddle River, NJ (US); Youn Bu Choi, Ridgewood, NJ (US)

(73) Assignee: Soon Kie Jung, Saddle River, NJ (US)

( * ) Notice: Subject to any disclaimer, the term of this patent is extended or adjusted under 35 U.S.C. 154(b) by 0 days.

(21) Appl. No.: 13/902,357

(22) Filed: May 24, 2013

(51) Int. Cl.

| | |
|---|---|
| ***E04B 2/00*** | (2006.01) |
| ***E04B 5/00*** | (2006.01) |
| ***E04B 9/00*** | (2006.01) |
| ***E04B 9/24*** | (2006.01) |
| ***E04B 9/06*** | (2006.01) |

(52) U.S. Cl.
CPC ..... *E04B 9/242* (2013.01); *E04B 9/067* (2013.01)
USPC ..... 52/506.09; 52/506.01; 52/506.03; 52/506.04; 52/506.06; 52/506.08

(58) Field of Classification Search
CPC ..... E04B 9/28; E04B 9/24; E04B 9/26; E04B 9/18; E04B 9/183
USPC ..... 52/506.09, 506.01, 506.03, 506.04, 52/506.06, 506.08
See application file for complete search history.

(56) References Cited

U.S. PATENT DOCUMENTS

| | | | | |
|---|---|---|---|---|
| 4,696,141 | A * | 9/1987 | Nassof | 52/506.07 |
| 4,760,677 | A * | 8/1988 | Nassof | 52/506.1 |
| 5,417,025 | A * | 5/1995 | Nute et al. | 52/483.1 |
| 6,230,463 | B1 * | 5/2001 | Bodine | 52/506.07 |
| 6,523,314 | B1 * | 2/2003 | LaLonde et al. | 52/506.07 |
| 8,316,607 | B2 * | 11/2012 | Eisner et al. | 52/506.09 |
| 2011/0252735 | A1 * | 10/2011 | Eisner et al. | 52/506.05 |

* cited by examiner

*Primary Examiner* — Mark Wendell
(74) *Attorney, Agent, or Firm* — Sughrue Mion, PLLC

(57) ABSTRACT

The present disclosure relates to a ceiling mount system for installing a ceiling panel on a grid support body. The ceiling mount system according to an exemplary embodiment of the present disclosure includes clip main bodies coupled to upper surfaces of ceiling panels and configured to accommodate end portions of the grid support body, a pressing block facing an end portion of the grid support body, which is accommodated inside the clip main body, and installed to be able to linearly reciprocate, and one or more clips including an elastic member which provides elastic force to the pressing block inside the clip main body.

6 Claims, 4 Drawing Sheets

CEILING MOUNT SYSTEM

TECHNICAL FIELD

The present disclosure relates to a ceiling mount system, and more particularly, to a ceiling mount system capable of easily installing a plurality of ceiling panels from a position below a grid support body.

BACKGROUND

In general, the ceiling panels, which are manufactured in diverse materials and shapes, are installed in the various buildings and the structures in order to enhance the aesthetics of the ceiling by hiding the upper structure such as pipes for water and sewage, pipes for air conditioning, wires for communication or electrical supply, and the likes. The ceiling panels are fixed to the upper structure by a ceiling mount system.

In the related art, the conventional ceiling mount system installs and fixes the ceiling panel to the upper structure by nails, screws or the likes in order to achieve a safe installation.

However, this type of system is not suitable for locations where frequent maintenance is required due to its affixed nature.

Most commonly, the ceiling mount system employs metal grids, and dropping the panel on the metal grid is the most universally applied method.

However, when using the aforementioned method, the metal grid becomes fully exposed to people's views, and this limits the use of various types of aesthetic ceiling materials.

SUMMARY

The present disclosure has been made in an effort to provide a ceiling mount system capable of facilitating installation and separation of a ceiling panel.

An exemplary embodiment of the present disclosure provides a ceiling mount system including: a grid support body suspended on a ceiling of a building structure, a plurality of ceiling panels, and a plurality of clips mounted on upper surfaces of the plurality of ceiling panels, respectively and configured to connect the plurality of ceiling panels to the grid support body. One or more of the plurality of clips include clip main bodies coupled to upper surfaces of the plurality of ceiling panels and configured to accommodate end portions of the grid support body, a pressing block facing an end portion of the grid support body, which is accommodated inside the clip main body, and installed to be able to linearly reciprocate in a direction toward the end portion of the grid support body, and an elastic member configured to provide elastic force to the pressing block inside the clip main body.

The elastic member may be a coil spring.

The clip main body may include a cylinder portion in which the pressing block reciprocates, and a holding portion which prevents the pressing block from being moved away.

The elastic member may be installed inside the cylinder portion of the clip main body.

The grid support body may include main members extended toward the ceiling of the building structure, and tee members bent and extended in both directions from end portions of the main members. An end portion of the tee member may be inserted into the clip main body.

The grid support body may be made of a metallic material.

The plurality of clips may include a first clip having the clip main body, the pressing block, and the elastic member and installed on an upper surface of one side of the plurality of ceiling panels, and a second clip having the clip main body and installed on an upper surface of the other side of the plurality of ceiling panels, which is opposite to the one side.

According to the exemplary embodiment of the present disclosure, the ceiling mount system may easily install and separate the ceiling panel, and moreover, may minimize exposure of the grid support body which supports the ceiling panel.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
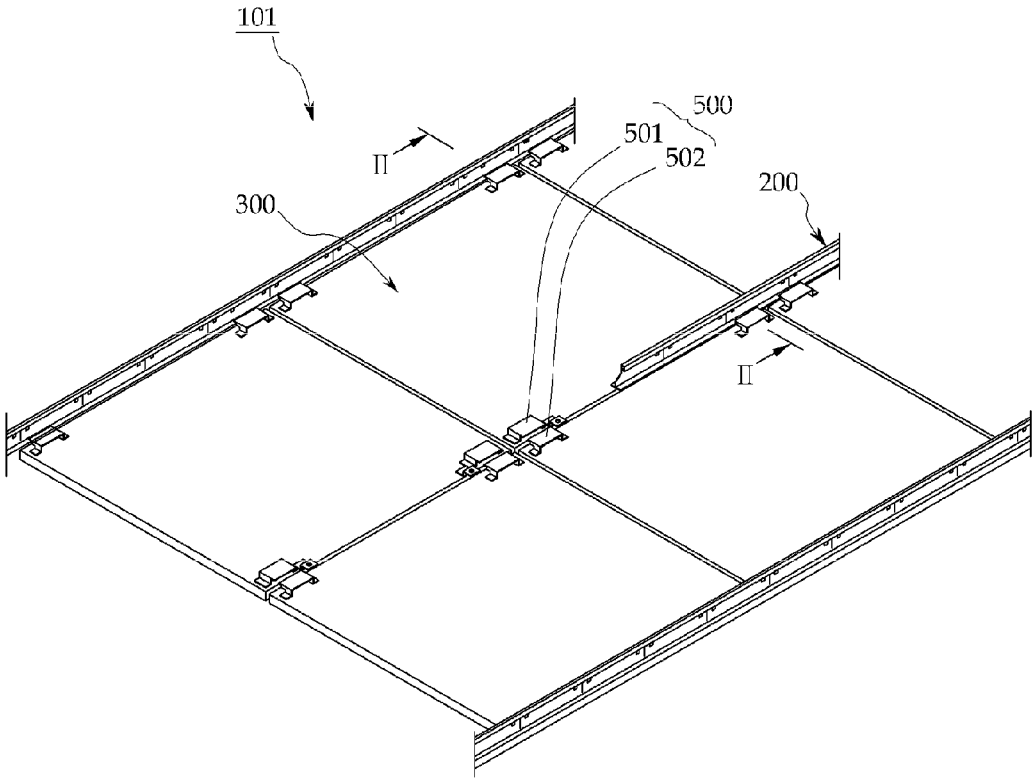
FIG. 1 is a perspective view of a ceiling mount system according to an exemplary embodiment of the present disclosure.

In the following detailed description, reference is made to the accompanying drawing, which form a part hereof. The illustrative embodiments described in the detailed description, drawing, and claims are not meant to be limiting. Other embodiments may be utilized, and other changes may be made, without departing from the spirit or scope of the subject matter presented here.

Hereinafter, an exemplary embodiment of the present disclosure will be described in detail with reference to the accompanying drawings so that those persons skilled in the art may readily carry out the present disclosure. The present disclosure may be implemented in various different forms and is not limited to the exemplary embodiment which will be described below.

The drawings are schematic and illustrated so as not to coincide with the scale. Relative measurements and ratios of parts illustrated in the drawings are illustrated to be exaggerated and contracted in terms of size for clarity and convenience in the drawings, and arbitrary measurements are just illustrative and not restrictive. The same reference numerals are used to represent the same structures, elements or components, which are illustrated in two or more drawings, in order to show similar properties.

The exemplary embodiment of the present disclosure specifically presents an ideal exemplary embodiment of the present disclosure. As a result, various modifications on the illustrations are expected. Therefore, the exemplary embodiment is not limited to specific forms in the illustrated range, and includes modification of forms by manufacture.

In order to clearly describe the present disclosure, parts that are irrelevant to the description are omitted, and like numerals refer to like or similar constituent elements throughout the specification.

Hereinafter, referring to FIGS. 1 and 2, a ceiling mount system 101 according to an exemplary embodiment of the present disclosure will be described.

As illustrated in FIG. 1, the ceiling mount system 101 includes a grid support body 200, a plurality of ceiling panels 300, and a plurality of clips 500.

Figure 2:
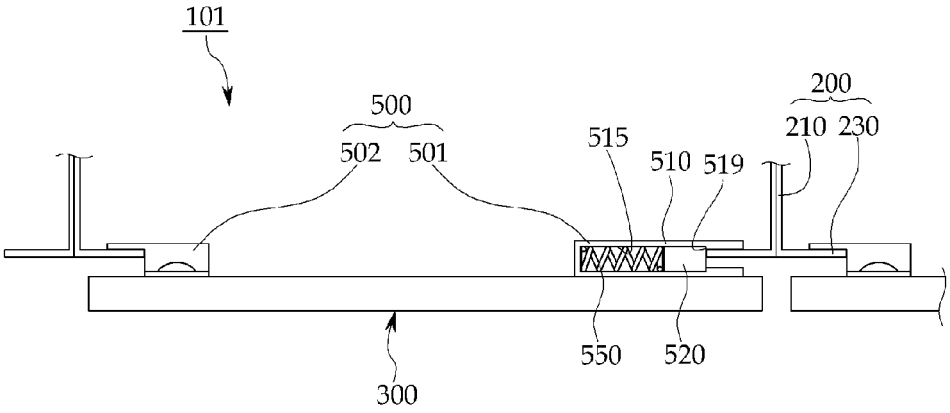
FIG. 2 is a cross-sectional view taken along line II-II of FIG. 1.

As illustrated in FIG. 2, the grid support body 200 includes main members 210 extended to be connected to a ceiling of a building structure, and tee members 230 bent and extended in both directions from end portions of the main members 210. Here, the main members 210 and the tee members 230 may be integrally formed, or may be coupled to each other after being separately formed, respectively.

The grid support body 200 may be made of a metallic material.

The plurality of ceiling panels 300 is connected to the grid support body 200 from a position below the grid support body 200. The ceiling panel 300 may be made of various materials that are publicly known to those persons skilled in the art.

The plurality of clips 500 is mounted on upper surfaces of the plurality of ceiling panels 300, respectively, so as to connect the plurality of ceiling panels 300 to the grid support body 200 by suspending the plurality of ceiling panels 300 on the grid support body 200. As such, the ceiling panel 300 may be connected to the grid support body 200 by the plurality of clips 500 from a position below the grid support body 200.

In the exemplary embodiment of the present disclosure, the plurality of clips 500 may include a first clip 501 and a second clip 502, which have structures different from each other. The first clip 501 may be installed on an upper surface of one side of the ceiling panel 300, and the second clip 502 may be installed on an upper surface of the other side of the ceiling panel 300, which is opposite to the one side.

However, the exemplary embodiment of the present disclosure is not limited thereto, and the plurality of clips 500 may include the first clip 501 except for the second clip 502.

The first clip 501 and the second clip 502 similarly have clip main bodies 510 coupled to the upper surface of the ceiling panel 300 and configured to accommodate end portions of the grid support body 200. Here, an end portion of the tee member 230 of the grid support body 200 is inserted and held into the clip main body 510.

The first clip 501 further includes a pressing block 520 and an elastic member 550 in addition to the clip main body 510.

The pressing block 520 is installed to be able to linearly reciprocate in a direction toward the end portion of the grid support body 200, which is accommodated inside the clip main body 510, specifically the inserted end portion of the tee member 230. The elastic member 550 provides elastic force to the pressing block 520. Here, the elastic force provided by the elastic member 550 presses the pressing block 520 in a direction toward the inserted end portion of the tee member 230.

For example, the elastic member 550 may be a coil spring. However, the exemplary embodiment of the present disclosure is not limited thereto, and various elastic members 550, which are publicly known to those persons skilled in the art, may be used.

Unlike the second clip 502, the clip main body 510 of the first clip 501 may have a cylinder portion 515 in which the pressing block 520 reciprocates and the elastic member 550 is installed, and a holding portion 519 formed on one side of the cylinder portion 515 so as to prevent the pressing block 520 from being moved away, in addition to accommodating the end portion of the grid support body 200. Here, the one side of the cylinder portion 515, on which the holding portion 519 is formed, is one side in a direction in which the end portion of the tee member 230 is inserted.

Hereinafter, an operational principle of the ceiling mount system 101 according to the exemplary embodiment of the present disclosure will be specifically described with reference to FIGS. 3 and 4.

Figure 3:
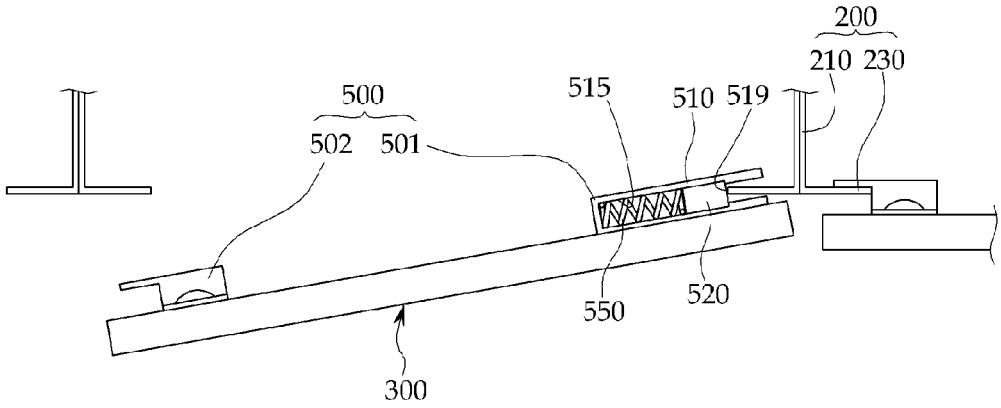
FIGS. 3 and 4 are cross-sectional views sequentially illustrating a process of installing a ceiling panel of the ceiling mount system of FIG. 2.

When the ceiling panel 300 is suspended and installed on the grid support body 200, first, as illustrated in FIG. 3, the end portion of the grid support body 200 is inserted into the first clip 501, and then the ceiling panel 300 is pressed in a direction toward the inserted tee member 230 of the grid support body 200.

The pressing block 520 of the first clip 501, which is in direct contact with the grid support body 200, enters by pushing the elastic member 550 while being pushed by the end portion of the tee member 230.

Figure 4:
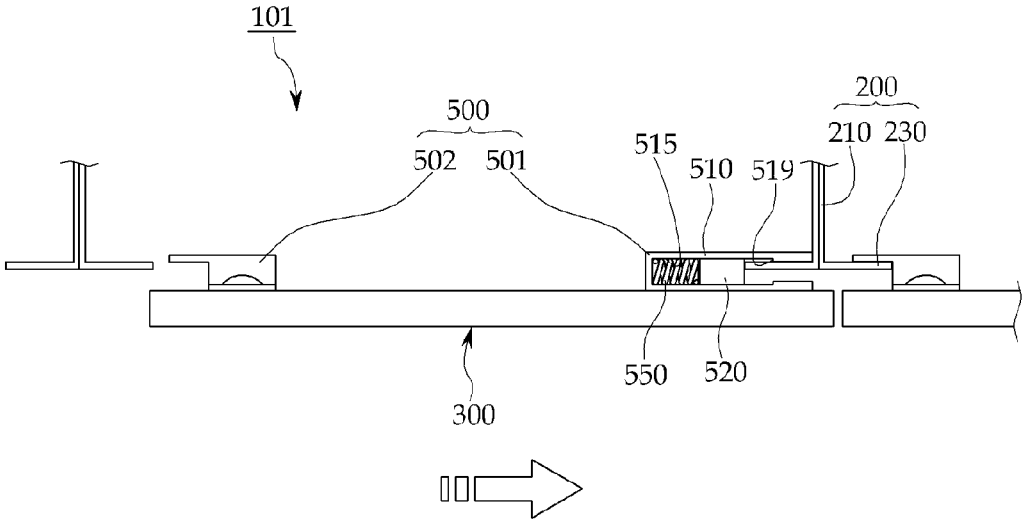

Next, as illustrated in FIG. 4, when the second clip 502 is positioned to face the opposite end portion of the grid support body 200, and then the pressing operation against the ceiling panel 300 is released, as illustrated in FIG. 2, the opposite end portion of the grid support body 200 is inserted into the second clip 502 while the pressing block 520 pushes the grid support body 200 by elastic force of the elastic member 550.

Accordingly, the ceiling panel 300 is easily suspended and installed on the grid support body 200. Even after the ceiling panel 300 is installed on the grid support body 200, the ceiling panel 300 may be stably supported without being freely moved by elastic force provided by the elastic member 550.

When the ceiling panel 300 is to be separated for maintenance, the ceiling panel 300 may be easily separated from the grid support body 200 in accordance with the reverse order of the aforementioned installation process.

According to the exemplary embodiment of the present disclosure, the ceiling panel 300 is connected to the grid support body 200 from a position below the grid support body 200 by the plurality of clips 500 installed on the upper surface of the ceiling panel 300 such that the ceiling panel 300 covers the grid support body 200, and as a result, exposure of the grid support body 200 may be minimized. That is, according to the exemplary embodiment of the present disclosure, aesthetic design may be emphasized by using the ceiling panel 300.

According to the aforementioned configuration, the ceiling mount system 101 may easily install and separate the ceiling panel 300, and moreover, may minimize exposure of the grid support body 200 which supports the ceiling panel 300.

While the exemplary embodiment of the present disclosure has been described with reference to the accompanying drawings, it can be understood by those skilled in the art that the present disclosure may be implemented as other specific forms without changing the technical spirit and essential characteristics.

Accordingly, it should be understood that the exemplary embodiment described above is illustrative and not restrictive in terms of all aspects, the scope of the present disclosure and the description are defined by the appended claims, and it should be interpreted that the meanings and scope of the claims, and all changed or modified forms that derived from equivalent concepts of the claims are included in the scope of the present disclosure.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A ceiling mount system, comprising:

a grid support body suspended on a ceiling of a building structure;

a plurality of ceiling panels; and a plurality of clips mounted on upper surfaces of the plurality of ceiling panels, respectively and configured to connect the plurality of ceiling panels to the grid support body, wherein one or more of the plurality of clips include:

clip main bodies coupled to upper surfaces of the plurality of ceiling panels and configured to accommodate end portions of the grid support body;

a pressing block facing an end portion of the grid support body, which is accommodated inside the clip main body, and installed to be able to linearly reciprocate in a direction toward the end portion of the grid support body; and an elastic member configured to provide elastic force to the pressing block inside the clip main body;

wherein the clip main body includes a cylinder portion in which the pressing block reciprocates, and a holding portion which prevents the pressing block from being moved away.

2. The ceiling mount system of claim 1, wherein the elastic member is a coil spring.

3. The ceiling mount system of claim 1, wherein the elastic member is installed inside the cylinder portion of the clip main body.

4. The ceiling mount system of claim 1, wherein the grid support body includes main members extended toward the ceiling of the building structure, and tee members bent and extended in both directions from end portions of the main members, and an end portion of the tee member is inserted into the clip main body.

5. The ceiling mount system of claim 1, wherein the grid support body is made of a metallic material.

6. The ceiling mount system of claim 1, wherein the plurality of clips includes:

a first clip having the clip main body, the pressing block, and the elastic member and installed on an upper surface of one side of the plurality of ceiling panels; and a second clip having the clip main body and installed on an upper surface of the other side of the plurality of ceiling panels, which is opposite to the one side.

* * * * *